US010238564B2

(12) United States Patent
Fakhrizadeh

(10) Patent No.: US 10,238,564 B2
(45) Date of Patent: Mar. 26, 2019

(54) PORTABLE ASSISTIVE LIFT

(71) Applicant: Mohammad Fakhrizadeh, Saveh (IR)

(72) Inventor: Mohammad Fakhrizadeh, Saveh (IR)

( * ) Notice: Subject to any disclaimer, the term of this patent is extended or adjusted under 35 U.S.C. 154(b) by 327 days.

(21) Appl. No.: 15/294,700

(22) Filed: Oct. 15, 2016

(65) Prior Publication Data

US 2017/0181911 A1 Jun. 29, 2017

(51) Int. Cl.
*A61G 7/10* (2006.01)

(52) U.S. Cl.
CPC ..... *A61G 7/1046* (2013.01); *A61G 7/1017* (2013.01); *A61G 7/1051* (2013.01); *A61G 7/1074* (2013.01)

(58) Field of Classification Search
CPC ..... A61G 7/053; A61G 7/10; A61G 7/1011; A61G 7/1017; A61G 7/1046; A61G 7/1051; A61G 7/1074
See application file for complete search history.

(56) References Cited

U.S. PATENT DOCUMENTS 1,632,405 A * 6/1927 Harrison ..... B62M 1/18 280/226.1
2,375,908 A * 5/1945 Farmer ..... A61G 7/053 4/450
2,439,163 A * 4/1948 Farmer ..... A61G 7/053 5/86.1
2,539,346 A * 1/1951 Feist ..... A61G 7/053 5/86.1
3,869,171 A * 3/1975 Wilson ..... A61G 5/1002 297/215.13
5,269,501 A * 12/1993 Liegel ..... B66F 9/06 212/292
5,502,851 A * 4/1996 Costello ..... A61H 3/04 482/69
6,389,619 B1 * 5/2002 Dunn ..... A61G 7/1017 5/81.1 R
7,392,554 B1 * 7/2008 Su ..... A61G 7/1017 5/86.1
8,167,074 B1 * 5/2012 Tsiyoni ..... B60T 11/04 180/208
8,375,484 B2 * 2/2013 Ota ..... A61G 7/1017 5/81.1 R
8,650,676 B2 * 2/2014 Lin ..... A61G 7/1019 5/81.1 HS
8,650,677 B2 * 2/2014 Altena ..... A61G 5/14 5/81.1 R (Continued)

*Primary Examiner* — Peter M. Cuomo
*Assistant Examiner* — David R Hare

(57) ABSTRACT

A portable assistive lift comprising a vertical member comprising a handle bar and a central wheel controlled by the handle bar disposed at the top and bottom extremities thereof respectively, a pair of left and right support members, each of which comprising a horizontal top rod extending from the vertical member, a bottom rod comprising a side wheel receptacle for receiving a side wheel therewithin disposed at a distal extremity thereof and a connecting rod connecting the free and proximal extremities of the top and bottom rods respectively whereby, the vertical member and the top, bottom and the connecting rods from a U-shaped structure as viewed from top and a hook stand comprising a plurality of hooks about which a sling is coupled thereto wherein, the hook stand is adapted to be elevated and lowered.

20 Claims, 13 Drawing Sheets

(56) References Cited

U.S. PATENT DOCUMENTS

| | | | | |
|---|---|---|---|---|
| 2002/0125709 | A1* | 9/2002 | Wu | B62K 5/007<br>280/771 |
| 2006/0097557 | A1* | 5/2006 | Tholkes | A61G 5/14<br>297/330 |
| 2009/0249544 | A1* | 10/2009 | Palay | A61G 5/14<br>5/83.1 |
| 2009/0255747 | A1* | 10/2009 | Kasaba | B62D 51/02<br>180/208 |
| 2011/0247889 | A1* | 10/2011 | Kosco | B62K 5/025<br>180/208 |

* cited by examiner

PORTABLE ASSISTIVE LIFT

BACKGROUND OF THE INVENTION

The assistive lifts (both manual and motorized), in terms of the patient-mobility, are of two kinds, viz., stationary and mobile. A stationary lift is the one that is secured to a wall or ceiling wherein, as one can expect, the mobility thereof is rendered very limited whereby, the area covered by such lifts for moving a patient is accordingly very limited. Also, on the flipside, stationary lifts have high initial setup costs and are bulky.

The mobile lifts, although on the other hand, can be maneuvered and thereby cover a small patient-transfer area (such as, from bed to wheelchair and vice versa), most of them handle the patient from above, which likely leads to accidents resulting from tipping-overs, slippage of patients, etc. The mobile lifts known in the art have U or H-shaped bases, which ride on a plurality of small swivel caster wheels. The U or H-shaped bases interfere with getting closer to the center of gravity of the patients sometimes leading to instability in holding the patient. Further, the smaller caster wheels pose a problem in that they tend to be sensitive to coarse surfaces, such as over a carpeted flooring, etc.

Further, if the patient is lying down, the bases have boundary limitations with regard to the center of gravity. Therefore, in order to make up for this limitation, the lifts employ long and extended lifting arms. Consequently, to support the lengthy arms, the lifts employ longer bases along with heavy and large columns so as to reach the patient's center of gravity in order to properly lift them up in accordance with the patients' ever changing postures and positions. Even though they are on wheels, the relatively large-sized bodies of the lifts lead to limited and difficult maneuverability such as, for example, negatively affecting movement on different flooring like carpeted flooring or passing through doors for moving from one room to another or into a bathroom. Each patient transfer requires much energy to be expended because, in addition to the weight of the patient, the weight of the lifting arms must also be factored in.

However, in order to reduce the weight and size of the lifts, smaller lifts exist in the art, but can only be used for patients who have some abilities themselves. These lifts under no circumstances can be used for patients having severe problems such as, for example, Spastic Cerebral Palsy, etc. Even though some of these smaller lifters advertise that they can be used for a patient who is lying down, someone must position the lift to pass under their legs. This is a cumbersome process and may cause potential harm to the patient due to changes that occur in the position of their lifting member with respect to the patient during lifting.

In the light of the aforementioned, there is a need in the art for a compact and light mobile assistive lift that covers a large patient-transfer area with ease. Such lift should incorporate multiple functions and features thus reducing the need for numerous assistive devices. Such lift should easily be assembled and disassembled without the need for tools.

SUMMARY OF THE INVENTION

The present invention comprises a compact, portable assistive lift that not just limits itself to transferring a patient from one place to another and repositioning him/her, but also assists the patient in performing in the various activities of daily living (ADL) such as, changing clothes, bathing, exercising, eating and toileting. The lift is configured to be a standalone device as the lift is adapted to perform a plurality of functions thus eliminating the need for the employment of support devices, which are otherwise employed for ADL. The lift, before lifting the patient, is designed to get as close as possible to his/her centre of gravity thereby lifting the him/her according to his/her posture. This negates the need for employing longer lifting arms, which in turn need to be supported by bulky columns and bases. The lift, as a result of not being bulky, can pass through most doorways for covering a larger transfer area (such as, from a bed or floor to a wheelchair or from one room to another room or commode. Further, the lift is adapted to be operated at the chest level of the patient resulting in employing a shorter vertical column thus saving on energy, material, weight and accordingly the cost. The lift is adapted to be easily assembled and disassembled without the need for tools.

The lift comprises a centrally-disposed vertical member, a pair of right and left support members adjustably extending from either side of the vertical member. The vertical member comprises a vertical column, a handle bar disposed atop the vertical column and a central wheel connected at the bottom of the vertical column such that, the swiveling motion of the central wheel is controlled by the handle bar. The vertical column further comprises a terminal receptacle for receiving a user terminal for enabling a user to interact with the lift.

Each support member comprises an elongate, adjustable, horizontal top rod extending from the vertical column and an elongate bottom rod. The bottom rod, when viewed from top, is disposed in a perpendicular orientation with respect to the top rod, albeit in a different geometrical plane. The support member further comprises an oblique connecting rod connecting the top and bottom rods such that, when viewed from top, the vertical member coupled with the support members from a U-shaped structure. The U-shaped structure adds maneuverability when turning corners and, for example, avoids contact with a car door when transferring a patient into a vehicle. The U-shape also enables the lift to get as close as possible to the patient's centre of gravity especially, when he/she is in a laid down position. The adjustable length of the top rod allows the lift to accommodate various sized chairs and wheelchairs within the U-shape thereof. The bottom rod, which is elevated above the ground, terminates in a side receptacle carrying a side wheel. Notably, the bottom rod declines angularly as it extends from the side receptacle to the connecting rod. This adds stability when lifting and transporting a person. The lift is meant to be maneuvered about the central and side wheels. Notably, the central wheel is larger than the side wheels adding stability and maneuverability to the lift even on carpeted floors.

The lift further comprises an elongate stand member connected to the vertical column such that, the stand member, as viewed from top, bifurcates the aforementioned U-shaped structure of the lift. The free distal extremity of the stand member is hingedly fitted with a hook stand receptacle, which is adapted to receive the hook stand therewithin. The hook stand comprises a concave structure comprising a plurality of hooks aligned along the concave surface portion thereof. The hooks are adapted to receive a sling. The lift further comprises a telescopic actuator is obliquely hingedly secured between the stand member and the bottom of the vertical column whereby, the extension and retraction of the actuator results in the ascent and descent of the hook stand respectively. The actuation of the actuator is facilitated by the user terminal via a user interface, which preferably comprises a touch screen.

One aspect of the present disclosure is directed to a portable assistive lift comprising: (a) a vertical member comprising: (i) a vertical column; (ii) a handle bar disposed atop the vertical column; and (iii) a central wheel disposed at the bottom of the vertical column, the swiveling of the central wheel facilitated by the swiveling of the handle; (b) a pair of left and right support members, each of which comprising: (i) an elongate, horizontal top rod extending from the vertical column; (ii) an elongate bottom rod disposed below the top rod, the bottom rod being elevated above the ground, the top rod being in perpendicular orientation with respect to the bottom rod albeit in a different geometrical plane; (iii) a side wheel disposed at a distal extremity of the bottom rod whereby, the lift is maneuvered about the central and side wheels; and (iv) a connecting rod connecting the free and proximal extremities of the top and bottom rods respectively whereby, the vertical member and the top, bottom and the connecting rods from a chassis which would have no boundaries at floor level and in front of the lift; and (c) a hook stand connected to the vertical member, the hook stand comprising a plurality of hooks about which a sling is coupled thereto, the hook stand being elevatable and lowerable.

In one embodiment, the bottom rods are parallel to each other. In one embodiment, each bottom rod is at a declined slope from the respective side wheel to the connecting rod.

In one embodiment, the connecting rod is obliquely disposed as viewed from front, rear and the side. In another embodiment, when viewed from top, the top and bottom rods are perpendicular to each other, albeit in a different geometrical plane. In one embodiment, the length of the top rod is adjustable. In one embodiment, the top rod comprises: (a) a hollow outer rod extending from the vertical column; and (b) an inner rod adapted to be snugly received within the outer rod such that, the inner rod is slidable between short and long positions wherein, the length of the top rod is shortest and longest at the short and long positions respectively, the inner rod adapted to be locked within the outer rod at any position between short and long positions; the connecting rod extending from a distal extremity of the inner rod.

Further, there are wide open spaces between the vertical member, top rod, and the connecting rod in front of this lift, thereby there is no boundary and limitation for performing various tasks.

In one embodiment, the outer rod integrally extends from the vertical column. The outer rod is of uniform rectangular cross-section. The top and bottom surfaces of the outer rod are obliquely disposed with respect to the horizontal as the outer rod extends from vertical column. In one embodiment, the central wheel is larger than the side wheels. In another embodiment, the hook stand comprises: a concave rod; and a plurality of hooks extending outwardly from within the concave surface.

One embodiment of the present disclosure further comprises (a) an elongate stand member hingedly extending from the vertical column such that, the stand member, as viewed from top, bifurcates the right and left support members, a distal free end of the stand rod adapted to receive the hook stand therewithin; and (b) an obliquely-positioned, elongate telescopic actuator hingedly secured at the bottom of the vertical column; the actuator for elevating and lowering the hook stand; the actuator controlled from an electronic user terminal.

In one embodiment, the top and bottom extremities of the actuator are hingedly coupled to the stand member and the vertical column respectively. In one embodiment, the stand member comprises: (a) a pair of parallel, elongate top and bottom stand rods, each of which extending between a proximal and a distal extremity, the pair of stand rods hingedly connected to the vertical column at the proximal extremities thereof, the top extremity of the actuator hingedly secured to the bottom stand rod; and (b) a hook stand receptacle hingedly connected at the distal extremities of the pair of stand rods, the hook stand receptacle adapted for removably receiving the hook stand.

In one embodiment, the handle bar is foldable. The vertical column is of uniform rectangular cross-section. Preferably, the top bottom and the connecting rods are of uniform rectangular cross-section. In one example, the lift further comprises (a) a central wheel receptacle for rotably receiving the central wheel therewithin, the central wheel receptacle disposed at the bottom of the vertical column such that, the central wheel receptacle is disposed between the bottom of the vertical column and the central wheel; and (b) an elongate vertical swivel rod extending between the handle bar and the central wheel receptacle while being received within the vertical column; the swivel rod for facilitating the translation of swivel movement from the handle bar to the central wheel. In one embodiment, each of the central and side wheels comprises one of a caster wheel or a cartwheel with the latter being preferable. In one embodiment, the user terminal is removably secured to the vertical column.

Another aspect of the present disclosure is directed to a portable assistive lift comprising: (a) a vertical member comprising: (i) a vertical column; (ii) a handle bar disposed atop the vertical column; and (iii) a central cart wheel disposed at the bottom of the vertical column, the swiveling of the central wheel facilitated by the swiveling of the handle; (b) a pair of left and right support members, each of which comprising: (i) an elongate, horizontal top rod extending from the vertical column; (ii) an elongate bottom rod disposed below the top rod, the bottom rod elevated above the ground, the top rod being disposed in perpendicular orientation with respect to the bottom rod albeit in a different geometrical plane; (iii) a side cart wheel disposed at a distal extremity of the bottom rod whereby, the lift is maneuvered about the central and side wheels; and (iv) a connecting rod connecting the free and proximal extremities of the top and bottom rods respectively whereby, the vertical member, the top and bottom rods and the connecting rod that form a chassis in which the side wheels can be positioned at the side of the patient and the central wheel between his/her legs with no boundary to get close to the patient's center of gravity when in a lying down or sitting position; (c) a hook stand comprising a plurality of hooks about which a sling is coupled thereto; (d) an elongate stand member hingedly extending from the vertical column such that, the stand member, as viewed from top, bifurcates the right and left support members, a distal free end of the stand rod adapted to receive the hook stand therewithin; and (e) an obliquely-positioned, elongate telescopic actuator hingedly secured at the bottom of the vertical column; the actuator for elevating and lowering the hook stand; and (f) an electronic user terminal for controlling the extension and retraction of the actuator so as to control the ascent and descent of the hook stand respectively. In one embodiment, the user terminal is secured to the vertical column.

Other features and advantages will become apparent from the following description of the preferred embodiments, taken in conjunction with the accompanying drawings.

BRIEF DESCRIPTION OF DRAWINGS

Various embodiments of the disclosed system and method are described herein with reference to the accompanying drawings, which form a part of this disclosure, wherein.

Figure 1:
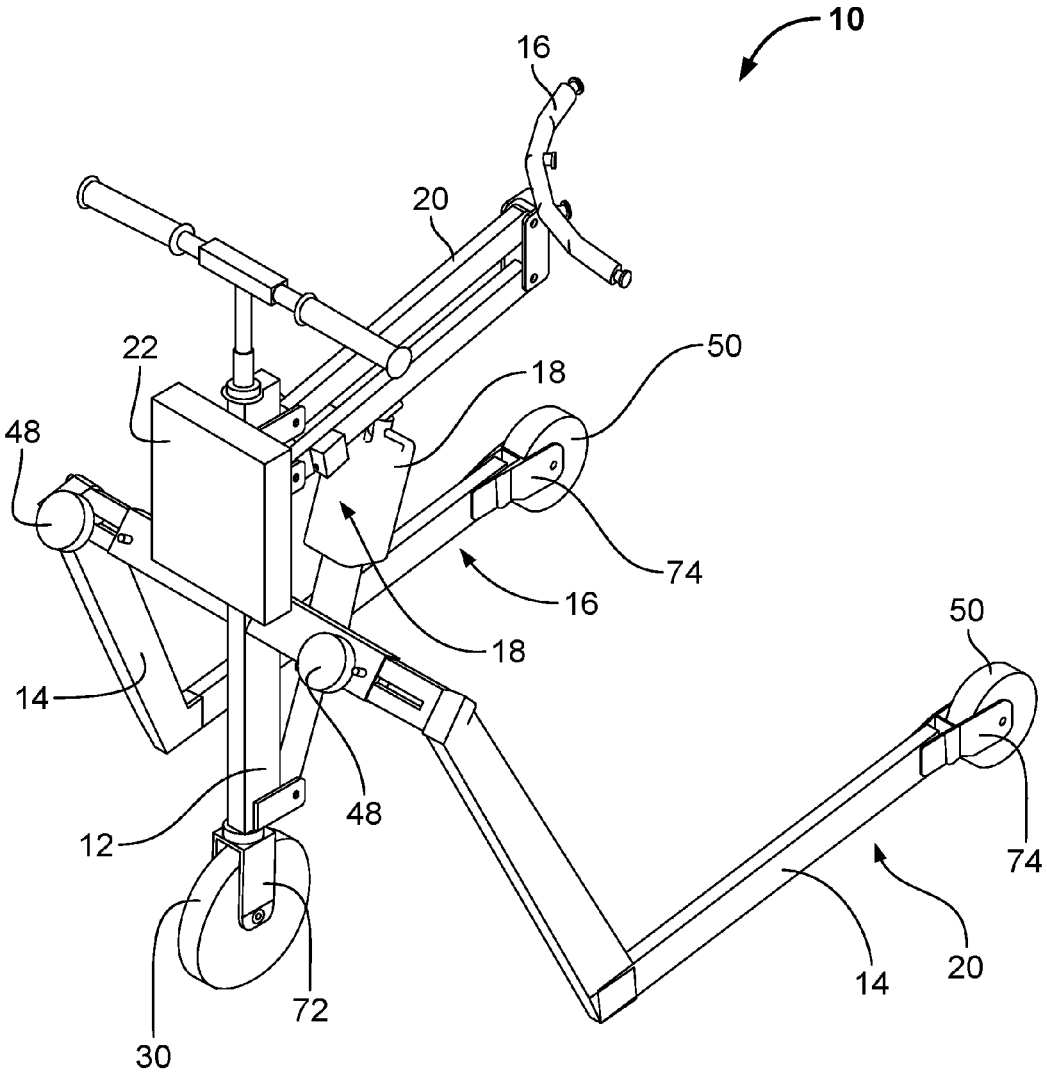
FIG. 1, according to an embodiment of the present invention, is a top perspective view of the assistive lift.

The various aspects of the present disclosure mentioned above are described in further detail with reference to the aforementioned figures and the following detailed description of exemplary embodiments.

FIGURES—REFERENCE NUMERALS

10—Portable Assistive Lift
12—Vertical Member
14—Support Member
16—Hook Stand
18—Telescopic Actuator
20—Stand Member
22—User Terminal
24—Vertical Column
26—Column Bore
27—Terminal Receptacle
28—Swivel Rod
30—Central Wheel
32—Handle
34—Handle Base
36—Unlock Button
38—Top Rod
40—Bottom Rod
42—Connecting Rod
44—Hollow Outer Rod
46—Inner Rod
48—Knob
49—Wheel receptacle
50—Side Wheel
52T—Top Stand Rod
52B—Bottom Stand Rod
54—Hook Stand Receptacle
55—Concave Rod
56—Hook
58—Insert
60—Insert Bore
62—Extension Device
64—Shaft
66—Hole
68—Lock
70—Angle Sensor
72—Central Wheel Receptacle
74—Side Wheel Receptacle

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The present disclosure relates to assistive lifts for the mobility-impaired and more particularly, to a compact assistive lift that is relatively simple in construction, light in weight, easy to handle, easily dismantlable and portable.

Figure 9A:
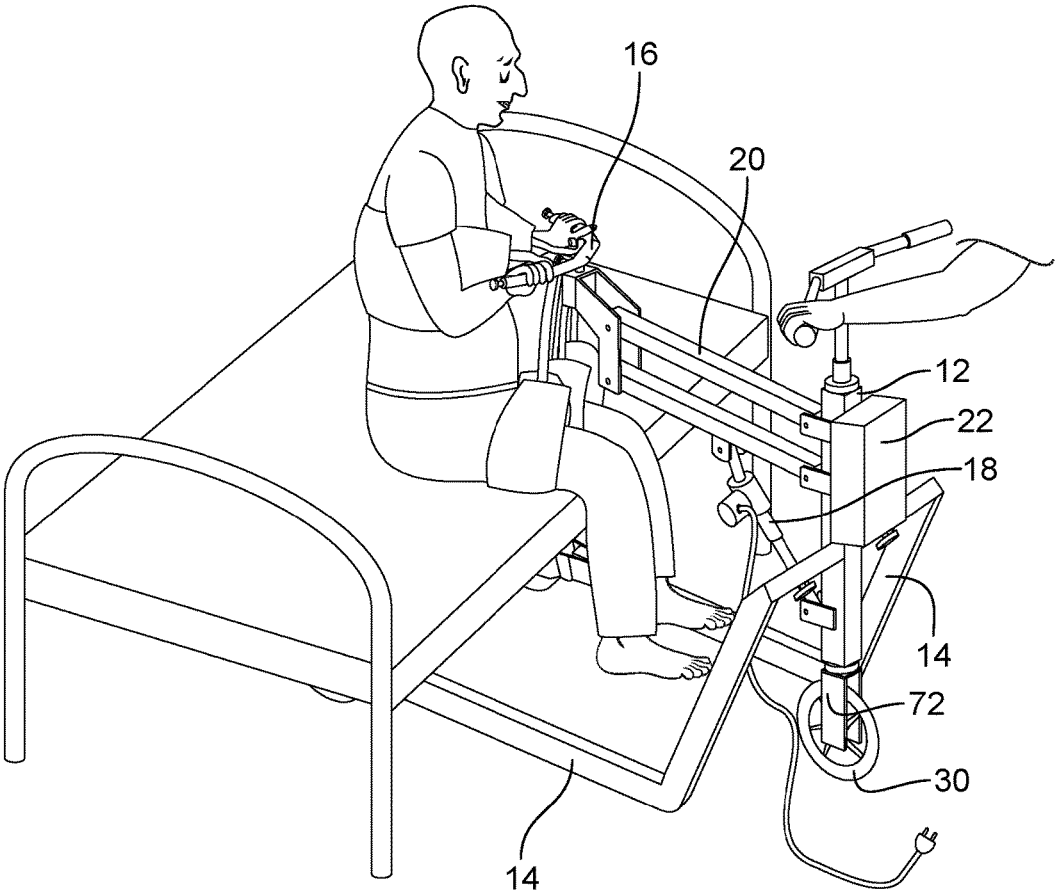
FIGS. 9A through 9C, according to an embodiment of the present invention, are pictures showing some of the applications of the lift.
Figure 9B:
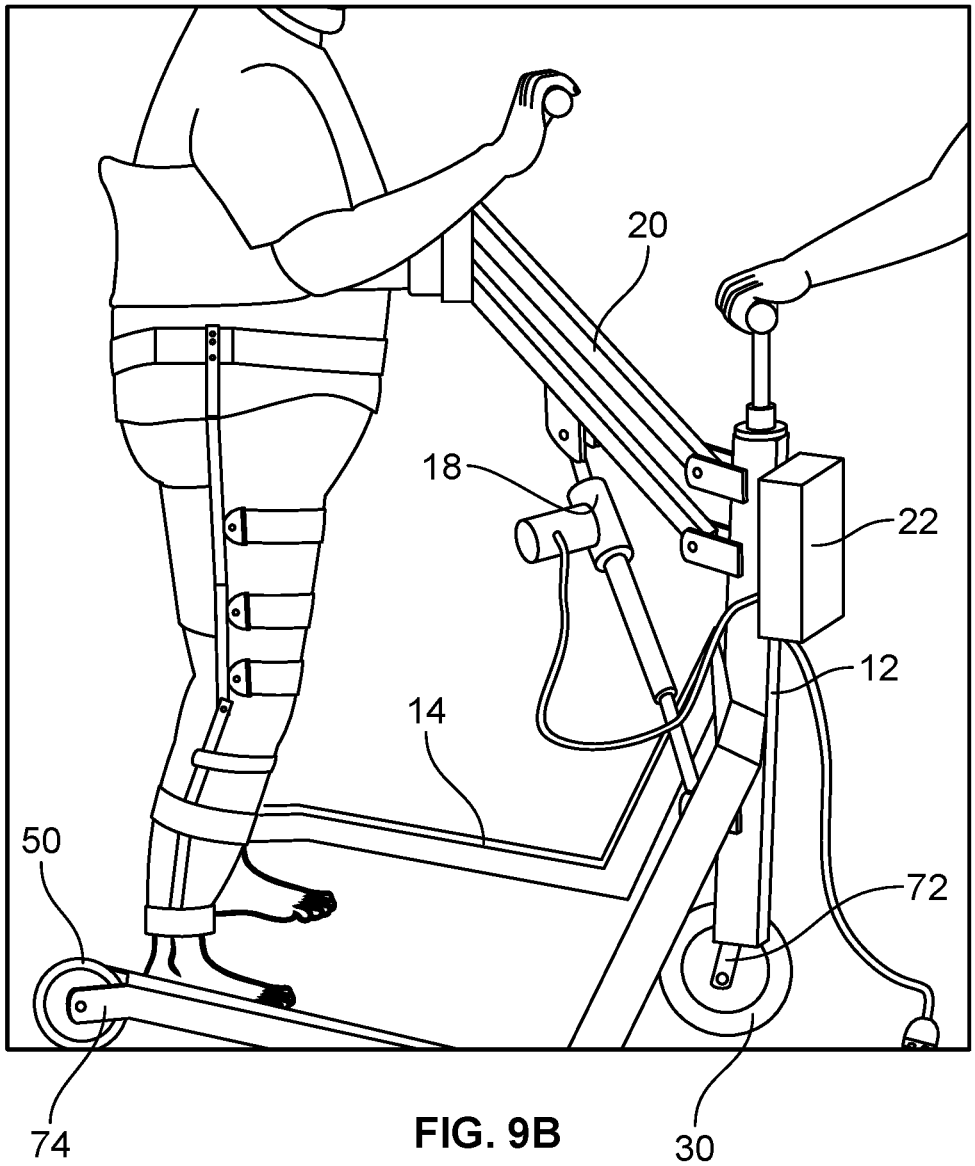
Figure 9C:
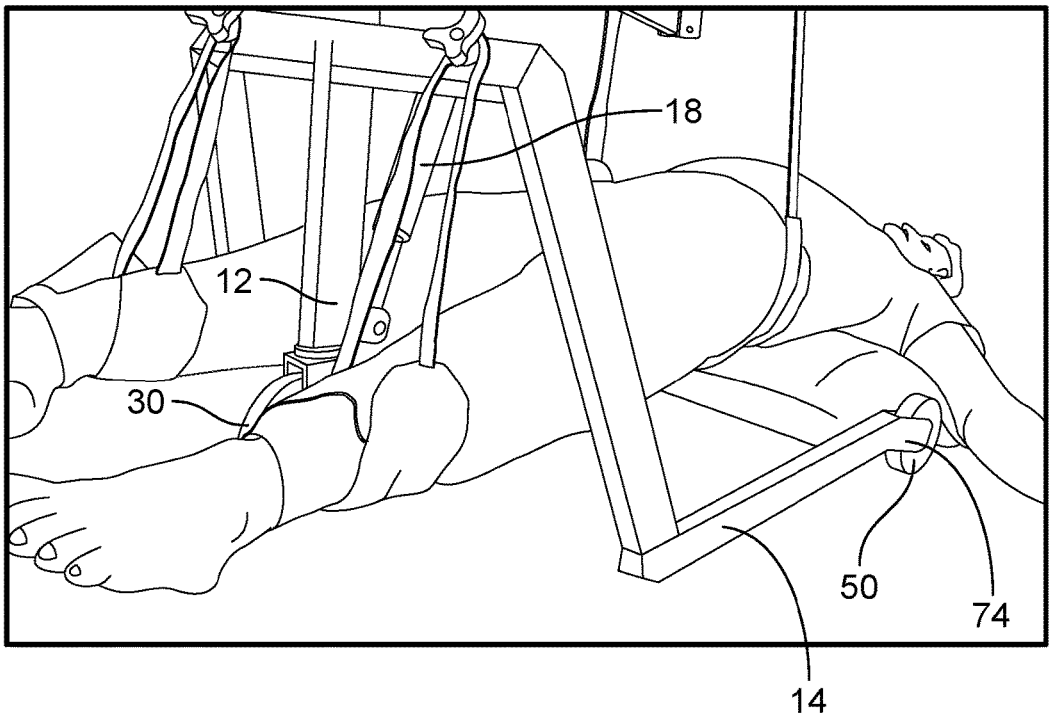

The present invention comprises a compact, portable assistive lift that, by lifting a mobility-impaired patient, not only transfers him/her from one place to another and eventually repositions him/her, but also assists the patient in performing activities of daily living (ADL) such as, changing clothes, bathing, exercising, eating and toileting, some of which are shown in FIGS. 9A through 9C. The lift is configured to perform a plurality of functions thereby eliminates the need for a group of support devices, which are otherwise used for ADL. The lift, prior to lifting the patient, is designed to get as close as possible to his/her centre of gravity so as to him/her according to his/her posture. The lift itself can be employed as a walker. The lift is adapted to be easily assembled and disassembled without the need for tools. The lift can also be employed for moving heavy objects from one place to another.

One aspect of the present disclosure is directed to a portable assistive lift comprising: (a) a vertical member comprising: (i) a vertical column; (ii) a handle bar disposed atop the vertical column; and (iii) a central wheel disposed at the bottom of the vertical column, the swiveling of the central wheel facilitated by the swiveling of the handle; (b) a pair of left and right support members, each of which comprising: (i) an elongate, horizontal top rod extending from the vertical column; (ii) an elongate rod disposed below the top rod, the bottom rod being elevated above the ground and declines from distal end to its proximal; (iii) a s side wheel disposed at a distal extremity of the bottom rod whereby, the lift is maneuvered about the central and side wheels; and (iv) a connecting rod connecting the free and proximal extremities of the top and bottom rods respectively whereby, the vertical member, the top, bottom and the connecting rods, as viewed from top, form U-shaped structure; and (c) a hook stand connected to the vertical member, the hook stand comprising a plurality of hooks about which a sling is coupled thereto, the hook stand being elevatable and lowerable. The connecting rod may be obliquely disposed as viewed from front, rear and the side.

Figure 2:
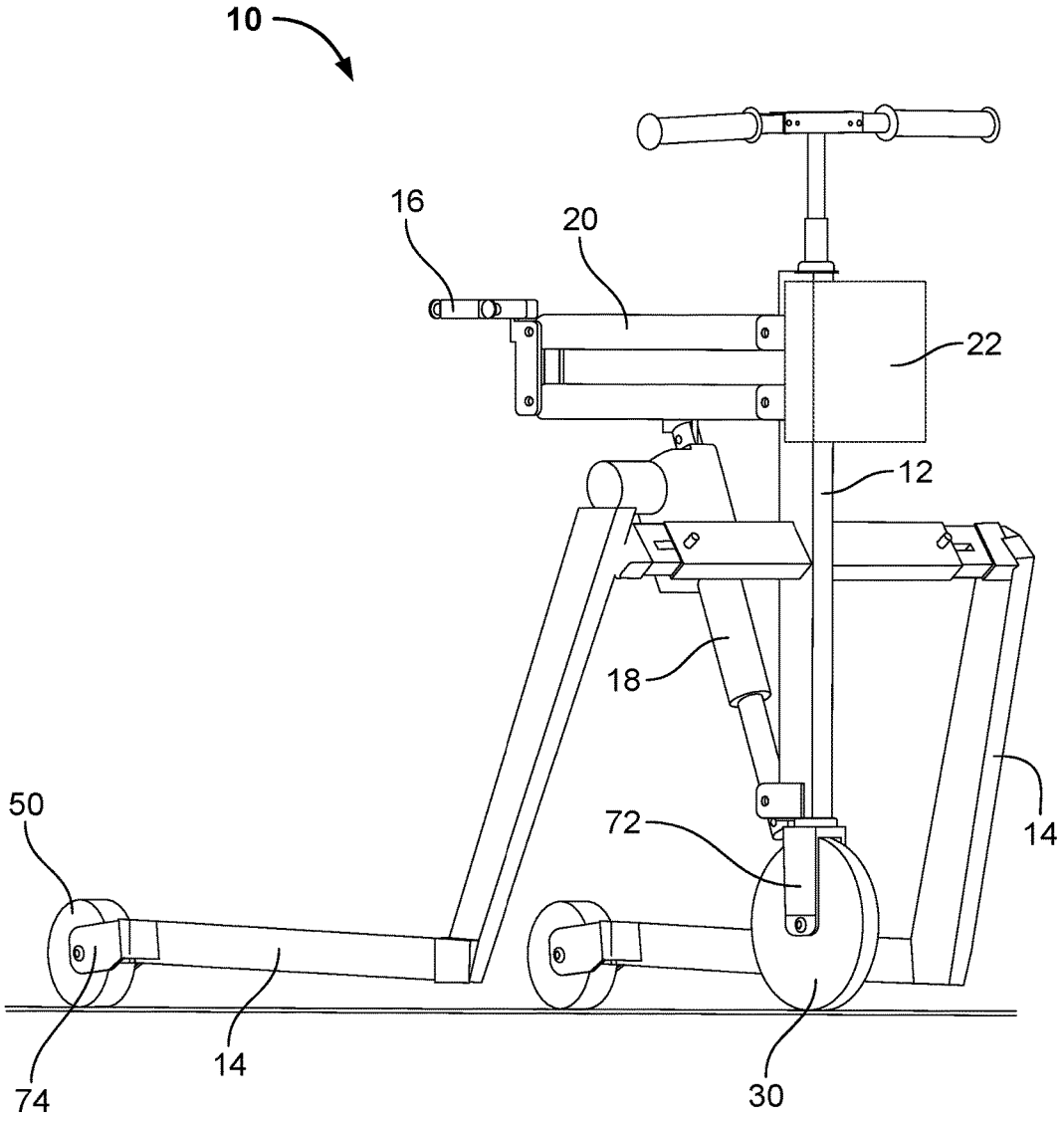
FIG. 2, according to an embodiment of the present invention, is a side perspective view of the assistive lift.
Figure 3:
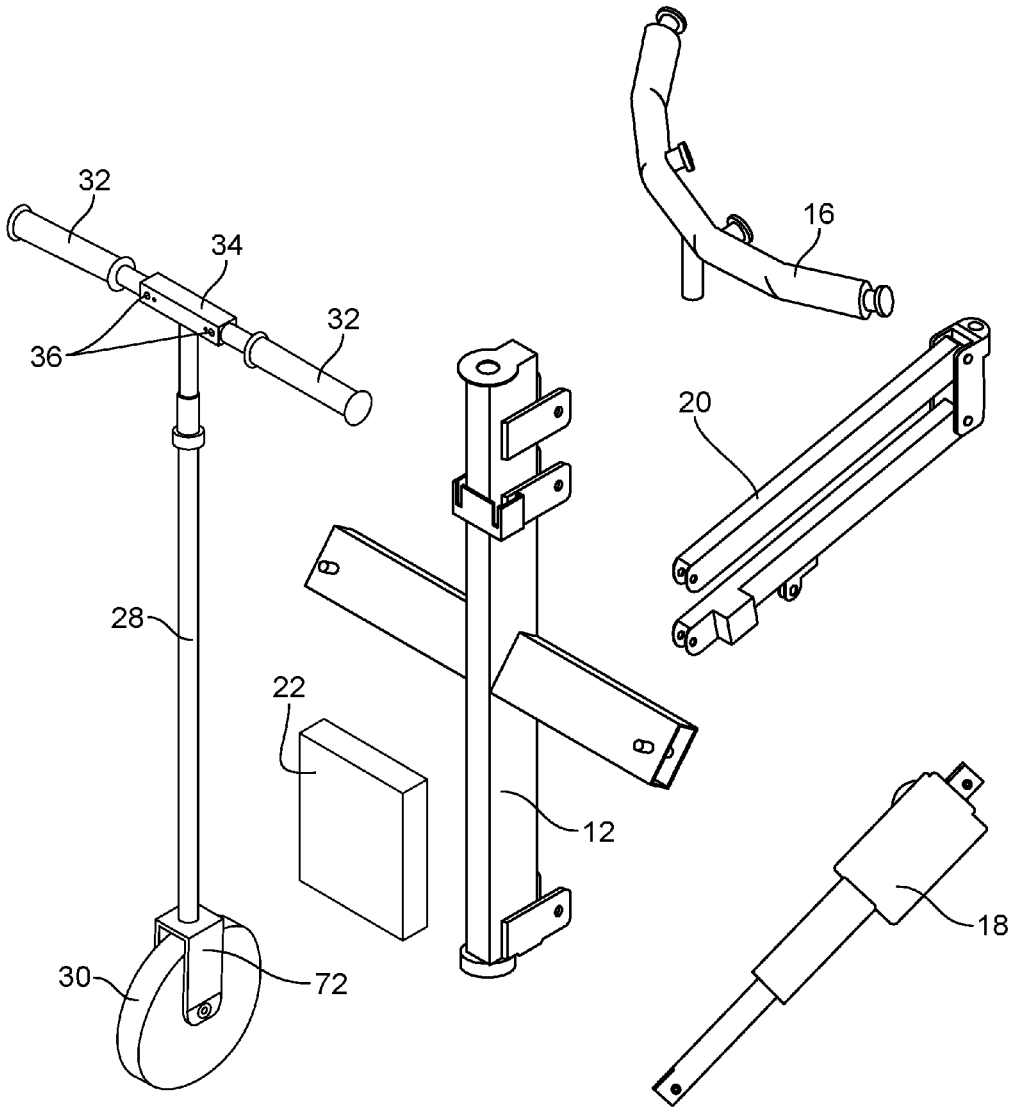
FIG. 3, according to an embodiment of the present invention, is an exploded perspective view of the assistive lift.
Figure 4:
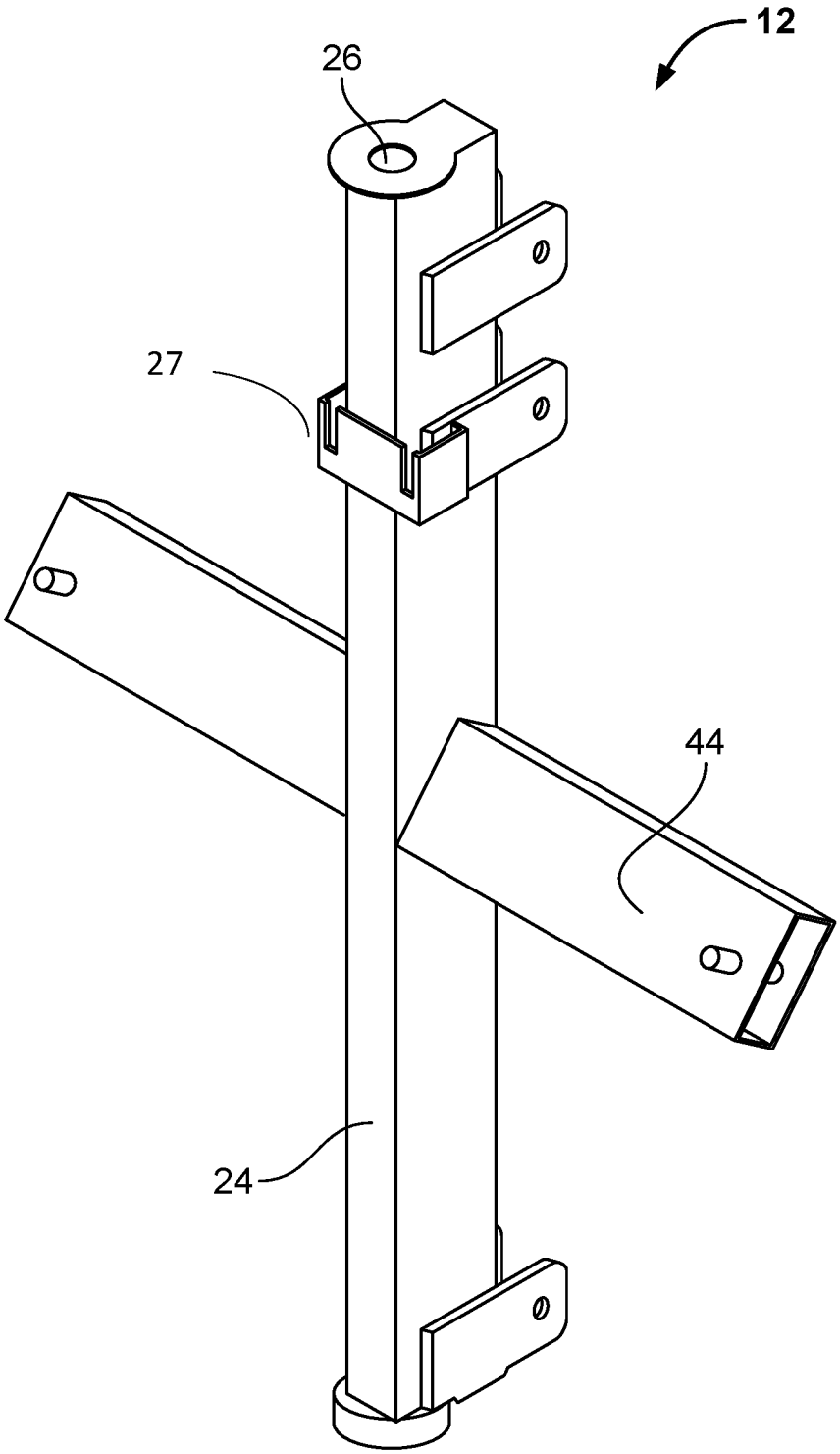
FIG. 4, according to an embodiment of the present invention, is a perspective view of the vertical member.
Figure 5:
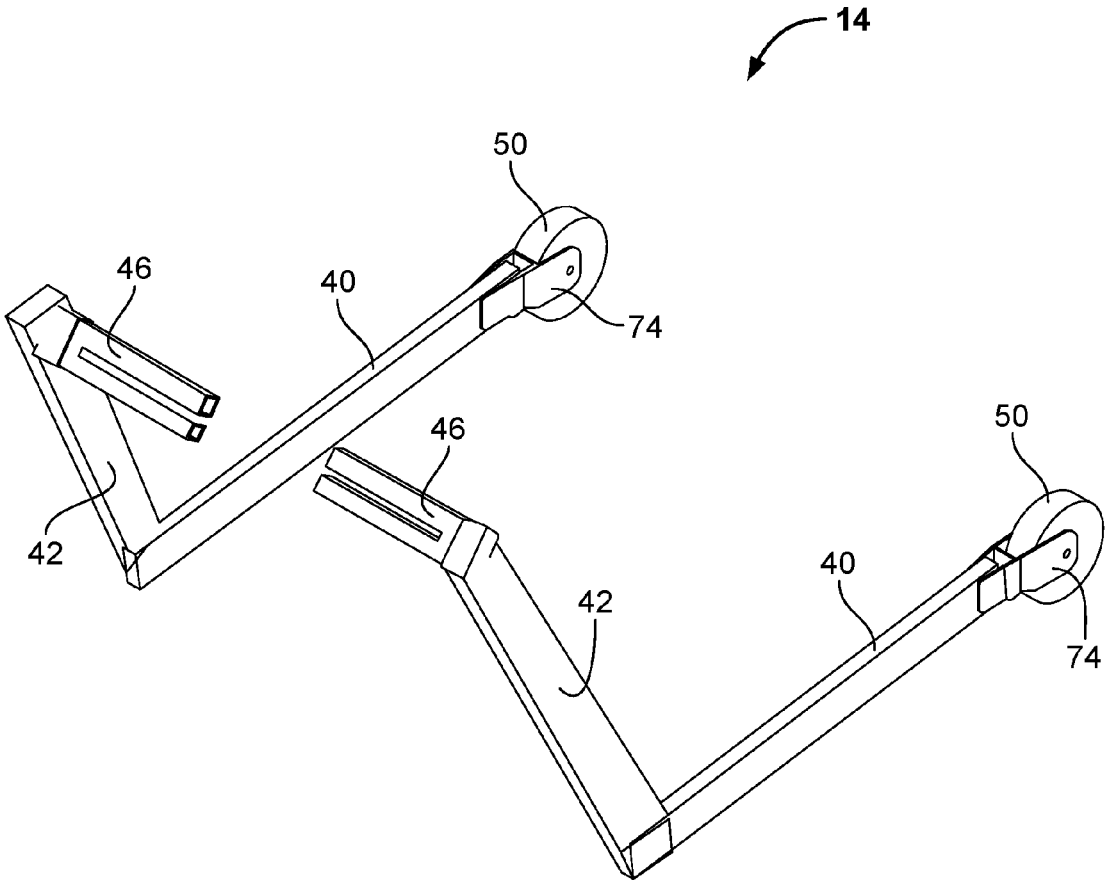
FIG. 5, according to an embodiment of the present invention, is a perspective view of the left and right support members.
Figure 6:
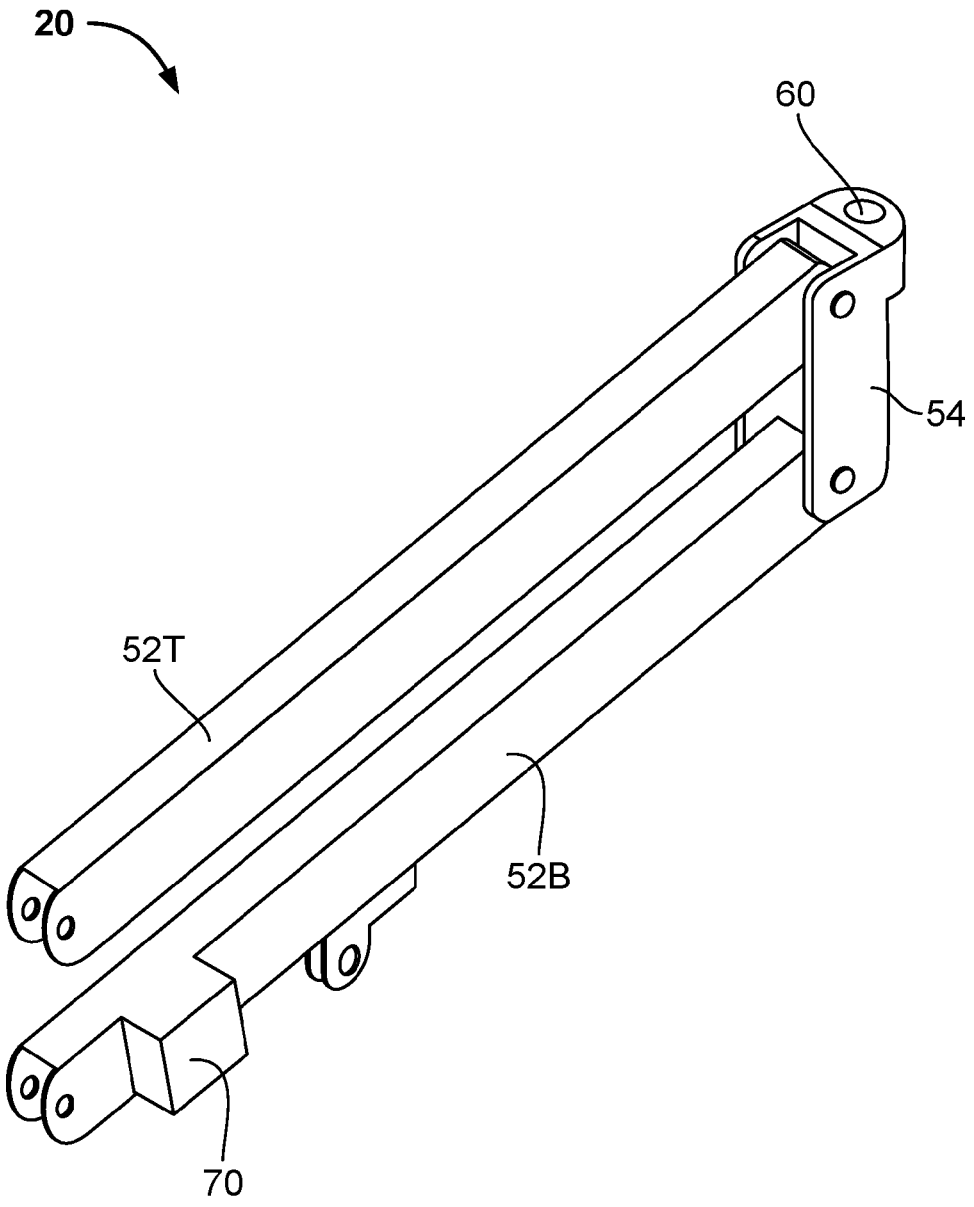
FIG. 6, according to an embodiment of the present invention, is a perspective view of the stand member.
Figure 7:
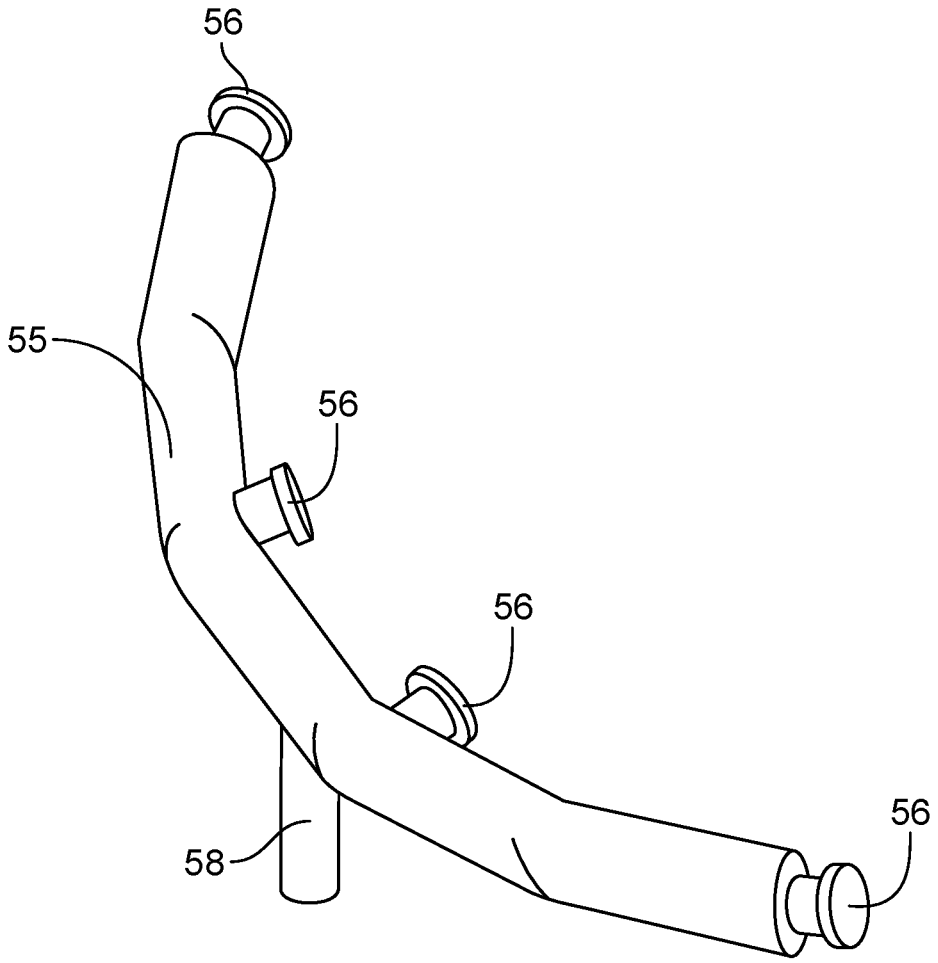
FIG. 7, according to an embodiment of the present invention, is a perspective view of the hook stand.
Figure 8A:
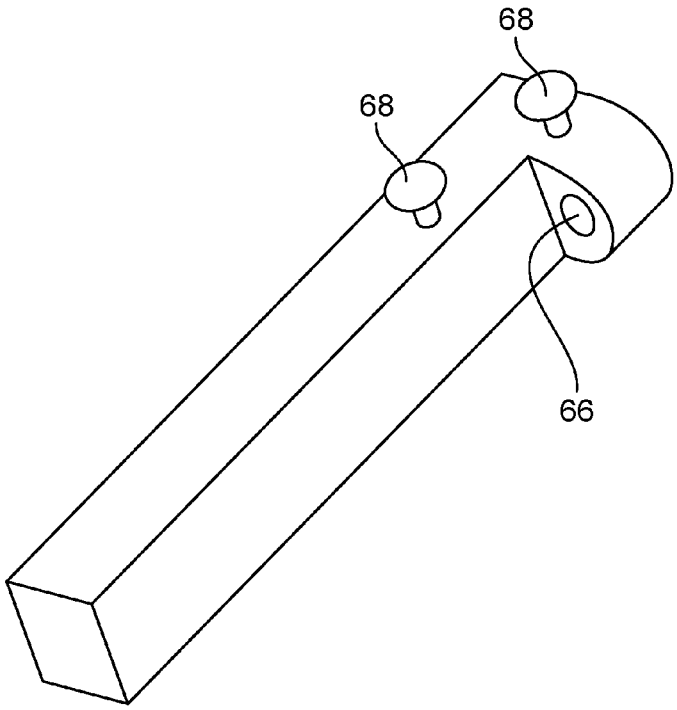
FIGS. 8A and 8B, according to an alternate embodiment of the present invention, are front and rear perspective views of the extension device.
Figure 8B:
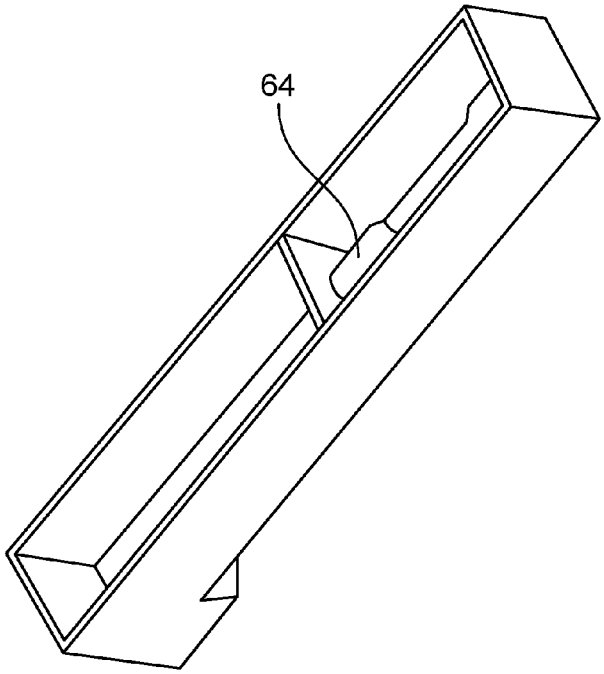

Referring to FIGS. 1 through 4, the lift 10 comprises a centrally-disposed vertical member 12, a pair of right and left support members 14 adjustably extending from either side of the vertical member 12, an elevatable and lowerable hook stand 16 supported by a telescopic actuator 18, a stand member 20, and an electronic user terminal 22 for controlling the actuator 18. The vertical member 12 comprises a vertical column 24 of uniform rectangular cross-section. Alternatively, the vertical column 24 can be of any cross-section as long as the functionality thereof is not compromised. Referring specifically to FIGS. 3 and 4, the vertical column 24 comprises a column bore 26 centrally disposed therewithin wherein, the column bore 26 is of uniform circular cross-section.

The vertical column 24 further comprises a terminal receptacle 27 for receiving the user terminal 22 therewithin. The user terminal 22 is employed for enabling a user to interact with the lift 10. Notably, the lift 10 is adapted to be operated at the chest level of the patient resulting in employing a shorter vertical column 12 thereby saving on the power, material, weight and cost of the lift 10. The vertical member 12 further comprises an elongate vertical swivel rod 28, which is adapted to be snugly and rotably received within the column bore 26. The vertical member 12 further comprises a foldable handle bar and a central wheel 30 attached to the top and bottom extremities of the swivel rod 28 respectively whereby, the swivel motion of the handle bar is imparted to the central wheel 30.

More particularly, the central wheel 30 comprises either a caster wheel or a cart wheel, with the latter being preferable. Notably, the central wheel 30 is rotably supported by a central wheel receptacle 72. The handle bar comprises a pair of handles 32, which are hingedly secured to a handle base 34 whereby, the handle bars are rendered foldable about the handle base 34. More particularly, the handle base 34 comprises a pair of unlock buttons 36, each of which pertaining to a handle 32 wherein, depressing the unlock button 36 allows the corresponding handle 32 to be folded.

Figure 10A:
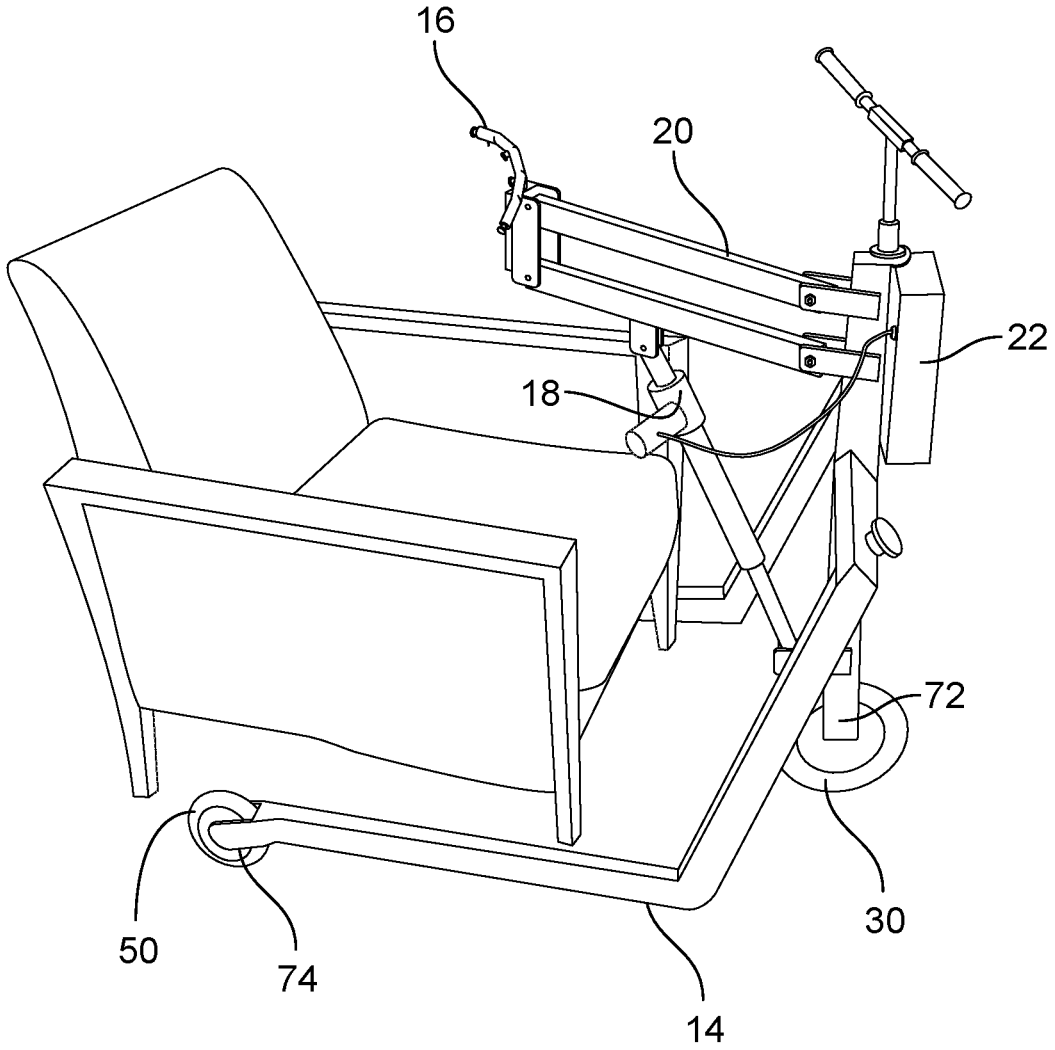
FIGS. 10A and 10B, according to an embodiment of the present invention, are pictures showing the lift accommodating a chair and a wheelchair.
Figure 10B:
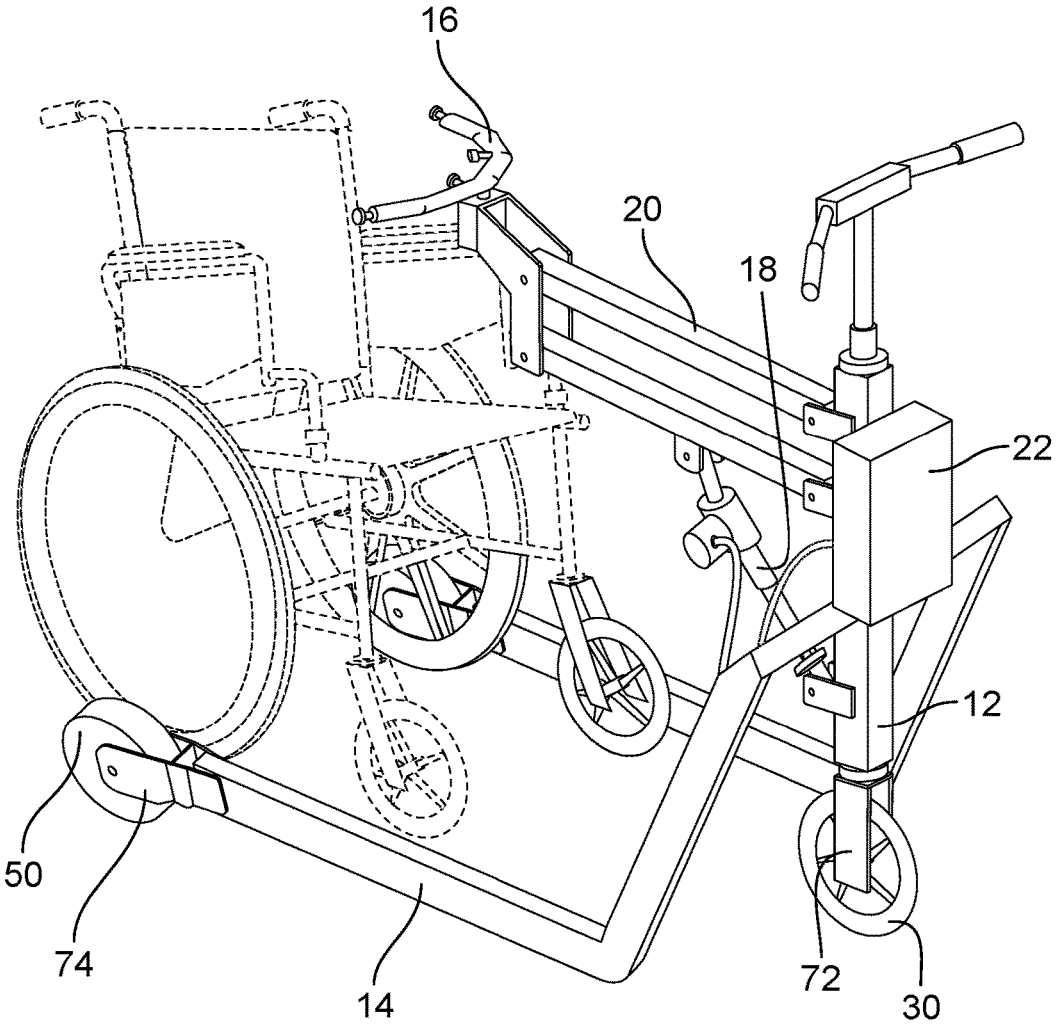

Referring to FIGS. 1 through 5, each support member 14 comprises an elongate, horizontal top rod 38, an elongate bottom rod 40 and a connecting rod 42 connecting the top and bottom rods 38 and 40. Notably, the top rod 38 is in perpendicular orientation with respect to the bottom rod 40 albeit in a different geometrical plane. The top, bottom, and the connecting rods 38, 40 and 42 are of uniform rectangular cross-section. However, notably, the top, bottom and connecting rods maybe of any cross-section as long as the functionality thereof are not interfered with. Further, there are wide open spaces between the vertical member 12, top rod 38, and the connecting rod 42 in front of this lift 10, thereby there is no boundary and limitation for performing various tasks. The length of the top rod 38 is adjustable as the top rod comprises a hollow outer rod 44 and an inner rod 46, which is adapted to be slidably received within the outer rod 44. The outer rod 44 extends integrally from a side longitudinal surface of the vertical member 12 such that, the longitudinal surfaces of the outer rod 44 are obliquely disposed. The inner rod 46, within the outer rod 44, is slidable between a long and a short position wherein, in the long and short positions, the length of the top rod 38 is longest and shortest respectively. The top rod 38 further comprises a knob 48 wherein, tightening the knob 48 at any position between the short and long positions (i.e., including the short and long positions) locks the length top rod 38. The adjustable length of the top rod 38 allows the lift 10 to accommodate various sized chairs and wheelchairs as shown in FIGS. 10A and 10B. This feature also facilitates the assembling and disassembling of the equipment.

Referring to FIGS. 1 through 5, the bottom rod 40, which is elevated above the ground, is perpendicular to the top rod 38, while the connecting rod 42 is obliquely oriented as viewed from front, rear, and side of the lift 10 resulting in an improvement in the maneuverability and the stability of the lift 10. When viewed from top, the vertical member 12 coupled with the support members 14 from a U-shaped structure. The U-shaped structure adds maneuverability when turning corners and, for example, avoids contact with a car door when transferring a patient into a vehicle. This shape of FIG. 2 also enables the lift to get as close as possible to the patient's center of gravity especially, when he/she is in a laid down position. The free end of the bottom rod 40 terminates in a side wheel 50 wherein, the lift 10 is maneuvered about the central and side wheels 30 and 50. Notably, the central wheel 30 is larger than the side wheels 50 so as to add stability and maneuverability to the lift 10 even on carpeted floors. Notably, the side wheel 50 is rotably supported by a side wheel receptacle 74. In one example, the bottom rod 40 angularly declines as it extends between the side wheel receptacle 74 and the corresponding connecting rod 42. Notably, the distance between the proximal end of the bottom rod 40 and the ground is designed so as to prevent the lift 10 from tipping over while lifting and moving a patient. As can be appreciated from FIG. 9C, the open space pertaining to the U-shaped structure makes it possible to allow the vertical member 12 to be as close as possible to the patient's centre of gravity adding stability to the lift 10 especially during lifting a patient.

The top rod 38, as viewed from top, may be disposed in a perpendicular orientation with respect to the bottom rod 40, albeit in a different geometrical plane. The length of the top rod 38 may be adjustable. In one example, the top rod 38 comprises (a) a hollow outer rod 44 extending from the vertical column 24; and (b) an inner rod 46 adapted to be snugly received within the outer rod 44 such that, the inner rod 46 is slidable between short and long positions wherein, the length of the top rod 44 is shortest and longest at the short and long positions respectively, the inner rod 46 adapted to be locked within the outer rod 44 at any position between short and long positions; the connecting rod 42 extending from a distal extremity of the inner rod 46.

The outer rod 44 may integrally extend from the vertical column 24. The outer rod 44 may be of uniform rectangular cross-section; the top and bottom surfaces of the outer rod 44 being obliquely disposed with respect to the horizontal as the outer rod 44 extends from vertical column. In one example, the central wheel 30 is larger than the side wheel 50. In one embodiment of the lift 10, the hook stand 16 comprises: (a) a concave rod 55; and (b) a plurality of hooks 56 extending outwardly from within the concave surface of the concave rod 55.

Referring to FIGS. 1 through 3, 6, and 7, the stand member 20 comprises a pair of top and bottom, horizontal stand rods 52T and 52B, each of which extending between a proximal and a distal extremity thereof. Notably, each stand rod 52 is of uniform circular cross-section. The stand member 20 is connected to the vertical member 12 as the top and bottom stand rods 52T and 52B are hingedly secured to the vertical column 24. Notably, the stand member 20, as viewed from top, bifurcates the aforementioned U-shaped structure of the lift 10. The distal extremities of the top and bottom stand rods 52T and 52B are hingedly fitted with a hook stand receptacle 54, which is adapted to receive the hook stand 16 therewithin.

Referring to FIGS. 6, 7, 8A and 8B, the hook stand 16 comprises a concave rod 55 comprising a plurality of hooks 56 aligned along the concave surface portion thereof. The hooks 56 are adapted to receive a sling (not shown) or an accessory that aids the patient. Notably, speaking of the accessories, the hook stand 16 is adapted to accept various accessories that can be used for physical and occupational therapies. For example, by attaching a waist brace (refer FIG. 9B) to the hook stand 16, the lift 10 makes it possible for the patient to stand or use the lift 10 as a walker. The hook stand 16 further comprises an insert 58 integrally extending therefrom wherein, the insert 58 is adapted to be snugly and removably received within an insert bore 60 of the hook stand receptacle 54. In one embodiment, as can be appreciated from FIGS. 8A and 8B, the lift 10 comprises an extension device 62 for the hook stand receptacle 54.

The extension device 62 acts an intermediary between the hook stand receptacle 54 and the sling (or other accessory). The extension device 62 comprises two shafts 64A and 64B, which, by placing any of these shafts 64 within the bore, makes it possible to use the steps comprising a thorough hole 66, which aligns with the insert bore 60. The extension device 62 can be fitted in two ways, viz., uprightly, where the hole 66 is disposed above the insert bore 60, and inversely, where the hole 66 is disposed below the insert bore 60. This would mean change in the range of the minimum and maximum height of the hook stand 16 (with respect to the ground) when received within the hole 66 resulting in benefiting shorter and taller patients.

For example, say, the distance between the length of the minimum and maximum elevation of the hook stand 16 is 60 centimeters as the minimum and maximum height is 40 and 100 centimeters respectively. By using the extension device 62 in the upright position, the minimum and maximum heights could be 20 and 80 centimeters respectively. On the other hand, by employing the extension device 62 in the inverse position, the minimum and maximum heights could be 60 and 120 centimeters respectively. The extension device 62 further comprised of at least two locks 68 for safety reasons.

The lift 10 may further comprise an elongate stand member 20 hingedly extending from the vertical column 24 such that, the stand member 20, as viewed from top, bifurcates the right and left support members 14, a distal free end of the stand member 20 adapted to receive the hook stand 16 therewithin; and an obliquely-positioned, elongate telescopic actuator 18 hingedly secured at the bottom of the vertical column 24; the actuator 18 for elevating and lowering the hook stand 16; the actuator 18 controlled from an electronic user terminal 22. The top and bottom extremities of the actuator 18 may be hingedly coupled to the stand member 20 and the vertical column 24 respectively.

The stand member 20 comprises: a pair of parallel, elongate top and bottom stand rods 52T and 52B, each of which extending between a proximal and a distal extremity, the pair of stand rods 52T and 52B hingedly connected to the vertical column 24 at the proximal extremities thereof, the top extremity of the actuator 18 hingedly secured to the bottom stand rod 52B; and a hook stand receptacle 54 hingedly connected at the distal extremities of the pair of stand rods 52T and 52B, the hook stand receptacle 54 adapted for removably receiving the hook stand 16.

Referring to FIGS. 1 through 3, the actuator 18 is secured between the vertical member 12 and the stand member 20. More particularly, the actuator 18 is obliquely hingedly secured between the bottom stand rod 52B (substantially midway between the centre of the bottom stand rod 52 and the vertical column 24) and the bottom of the vertical column 24 whereby, the extension and retraction of the actuator 18 results in the angular displacement of the stand member 20, which in turn leads to the ascent and descent of the hook stand 16 respectively. The actuation of the actuator 18 is facilitated by a user terminal via a user interface, which preferably comprises a touch screen.

The degree of extension or retraction to be inputted into the user terminal (which translates into adjusting the height of the hook stand 16) is enabled by an angle sensor 70 attached to the bottom stand rod 52B. The user terminal, which preferably comprises a touch screen device, is powered by a rechargeable battery. In one embodiment, the user terminal is configured to include two modes, viz., a manual operation or programmable. This allows the patient to choose how high a body part should be elevated, how long the elevated body part should stay suspended in the air, how long to rest on the floor and how many times this action could be repeated. In one embodiment, the user terminal is adapted to monitor the voltage applied and current used by the actuator 18 in combination with the rate of the changing angle of the top and bottom stand rods 52 enabling the processor to estimate the weight of a patient. Thus, the approximate weight of the patient can be continuously monitored.

One aspect of the present disclosure is directed to a portable assistive lift. The portable assistive lift comprises a vertical member comprising a vertical column; a handle bar disposed atop the vertical column; and (iii) a central wheel disposed at the bottom of the vertical column, the swiveling of the central wheel facilitated by the swiveling of the handle. The portable assistive lift further comprises a pair of left and right support members. Each of the left and right support members comprises (i) an elongate, horizontal top rod extending from the vertical column; (ii) an elongate bottom rod disposed below the top rod, the bottom rod being elevated above the ground and declines from the side wheel receptacle toward the front part of the device; (iii) a side wheel disposed at a distal extremity of the bottom rod whereby, the lift is maneuvered about the central and side wheels; and (iv) a connecting rod connecting the free and proximal extremities of the top and bottom rods respectively whereby, the vertical member, the top and bottom rods, and the connecting rod form a unique structure when viewed from the front. The portable assistive lift further comprises a hook stand connected to the vertical member, the hook stand comprising a plurality of hooks about which a sling is coupled thereto, the hook stand being elevatable and lowerable.

Another aspect of the present disclosure is directed to a portable assistive lift. The portable assistive lift comprises a vertical member comprising a vertical column; a handle bar disposed atop the vertical column; and a central wheel disposed at the bottom of the vertical column, the swiveling of the central wheel facilitated by the swiveling of the handle. The portable assistive lift may further comprise a pair of left and right support members, each of which comprises (i) an elongate, horizontal top rod extending from the vertical column; (ii) an elongate bottom rod disposed below the top rod, the bottom rod being elevated above the ground and declines from the side wheel receptacle toward the front part of the device; (iii) a side wheel disposed at a distal extremity of the bottom rod whereby, the lift is maneuvered about the central and side wheels; and (iv) a connecting rod connecting the free and proximal extremities of the top and bottom rods respectively whereby, the vertical member, the top and bottom rods and the connecting rod form a unique shape when viewed from the front.

The portable assistive lift may further comprise a hook stand comprising a plurality of hooks about which a sling is coupled thereto; and an elongate stand member hingedly extending from the vertical column such that, the stand member, as viewed from top, bifurcates the right and left support members, a distal free end of the stand rod adapted to receive the hook stand therewithin. The portable assistive lift may further comprise an obliquely-positioned, elongate telescopic actuator hingedly secured at the bottom of the vertical column; the actuator for elevating and lowering the hook stand. Moreover, the portable assistive lift may further comprise an electronic user terminal for controlling the extension and retraction of the actuator so as to control the ascent and descent of the hook stand respectively.

The connecting rod may be obliquely disposed as viewed from front, rear and the side. The top and bottom rods may be perpendicular to each other when viewed from the top. The length of the top rod may be adjustable. The top rod comprises a hollow outer rod extending from the vertical column; and an inner rod adapted to be snugly received within the outer rod such that, the inner rod is slidable between short and long positions wherein, the length of the top rod is shortest and longest at the short and long positions respectively, the inner rod adapted to be locked within the outer rod at any position between short and long positions; the connecting rod extending from a distal extremity of the inner rod.

The outer rod can integrally extend from the vertical column. As an example, it can also be of uniform rectangular cross-section; the top and bottom surfaces of the outer rod being obliquely disposed with respect to the horizontal as the outer rod extends from vertical column. Notably, the central wheel is larger than the side wheels. In one example, the hook stand comprises a concave rod; and a plurality of hooks extending outwardly from within the concave surface.

One embodiment of the present disclosure further comprises (a) an elongate stand member hingedly extending from the vertical column such that, the stand member, as viewed from top, bifurcates the right and left support members, a distal free end of the stand rod adapted to receive the hook stand therewithin; and (b) an obliquely-positioned, elongate telescopic actuator hingedly secured at the bottom of the vertical column; the actuator for elevating and lowering the hook stand; the actuator controlled from an electronic user terminal. The top and bottom extremities of the actuator can be hingedly coupled to the stand member and the vertical column respectively.

The stand member may comprise a pair of parallel, elongate top and bottom stand rods, each of which extending between a proximal and a distal extremity, the pair of stand rods hingedly connected to the vertical column at the proximal extremities thereof, the top extremity of the actuator hingedly secured to the bottom stand rod. The stand member may further comprise a hook stand receptacle hingedly connected at the distal extremities of the pair of stand rods, the hook stand receptacle adapted for removably receiving the hook stand. The handle bar of the portable assistive lift may be foldable. The vertical column may be of uniform rectangular cross-section, and the top, bottom and the connecting rods may be of uniform rectangular cross-section.

The portable assistive lift may further comprise a central wheel receptacle 72 for rotably receiving the central wheel therewithin, the central wheel receptacle 72 disposed at the bottom of the vertical column such that, the central wheel receptacle 72 is disposed between the bottom of the vertical column and the central wheel and a side wheel receptacle 74 for receiving the side wheel therewithin, the side wheel receptacle 74 disposed at the distal end of support member such that, the side wheel receptacle 74 is disposed between the distal end of the support member and the side wheel. The portable assistive lift may further comprise an elongate vertical swivel rod extending between the handle bar and the central wheel receptacle while being received within the vertical column; the swivel rod for facilitating the translation of swivel movement from the handle bar to the central wheel. In one example, each of the central and side wheels comprises on of a caster or a cartwheel with the latter being preferable.

Another aspect of the present disclosure is directed to a portable assistive lift comprising: (a) a vertical member comprising: (i) a vertical column; (ii) a handle bar disposed atop the vertical column; and (iii) a central cart wheel disposed at the bottom of the vertical column, the swiveling of the central wheel facilitated by the swiveling of the handle; (b) a pair of left and right support members, each of which comprising: (i) an elongate, horizontal top rod extending from the vertical column; (ii) an elongate, bottom rod disposed below the top rod, the bottom rod being elevated above the ground, the bottom rod, as viewed from top, is disposed in a perpendicular orientation with respect to the top rod albeit in a different geometrical plane; (iii) a side cart wheel disposed at a distal extremity of the bottom rod whereby, the lift is maneuvered about the central and side wheels; and (iv) a connecting rod connecting the free and proximal extremities of the top and bottom rods respectively whereby, the vertical member and the top, bottom and the connecting rods, as viewed from top, form U-shaped structure; (c) a hook stand comprising a plurality of hooks about which a sling is coupled thereto; (d) an elongate stand member hingedly extending from the vertical column such that, the stand member, as viewed from top, bifurcates the right and left support members, a distal free end of the stand rod adapted to receive the hook stand therewithin; and (e) an obliquely-positioned, elongate telescopic actuator hingedly secured at the bottom of the vertical column; the actuator for elevating and lowering the hook stand; and (f) an electronic user terminal for controlling the extension and retraction of the actuator so as to control the ascent and descent of the hook stand respectively.

Each of the central and side wheels may comprise a cart wheel. The bottom rod, in one example, declines as it extends from the side wheel to the connecting rod. The handle bar may be foldable. The vertical column may be of uniform rectangular cross-section. Moreover, each of the top, bottom and the connecting rods may be of uniform rectangular cross-section. The lift may further comprise a central wheel receptacle for rotably receiving the central wheel therewithin, the central wheel receptacle disposed at the bottom of the vertical column such that, the central wheel receptacle is disposed between the bottom of the vertical column and the central wheel; and an elongate vertical swivel rod extending between the handle bar and the central wheel receptacle while being received within the vertical column; the swivel rod for facilitating the translation of swivel movement from the handle bar to the central wheel.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A portable assistive lift comprising:

(a) a vertical member comprising:

(i) a vertical column;

(ii) a handle bar disposed atop the vertical column; and (iii) a central wheel disposed at a bottom end of the vertical column, with swiveling of the central wheel facilitated by swiveling of the handle;

(b) a pair of left and right support members, each of which comprising:

(i) an elongate, horizontal top rod extending from the vertical column;

(ii) an elongate rod disposed below the top rod, a bottom rod being elevated above ground and declines from distal end to its proximal;

(iii) a side wheel disposed at a distal extremity of the bottom rod whereby, the lift is maneuvered about the central and side wheels; and (iv) a connecting rod connecting the extremities of the top and bottom rods respectively whereby, the vertical member, the top, the bottom and the connecting rods, as viewed from above, form U-shaped structure; and (c) a hook stand connected to the vertical member, the hook stand comprising a plurality of hooks about which a sling is coupled thereto, the hook stand being elevatable and lowerable.

2. The lift of claim 1, wherein the connecting rod is obliquely disposed.

3. The lift of claim 1, wherein the top rod, as viewed from top, is disposed in a perpendicular orientation with respect to the bottom rod albeit in a different geometrical plane.

4. The lift of claim 1, wherein a length of the top rod is adjustable.

5. The lift of claim 4, wherein the top rod comprises:

(a) a hollow outer rod extending from the vertical column; and (b) an inner rod adapted to be snugly received within the outer rod such that, the inner rod is slidable between short and long positions wherein, the length of the top rod is shortest and longest at the short and long positions respectively, the inner rod adapted to be locked within the outer rod at any position between short and long positions; the connecting rod extending from a distal extremity of the inner rod.

6. The lift of claim 5, wherein the outer rod integrally extends from the vertical column.

7. The lift of claim 5, wherein the outer rod is of uniform rectangular cross-section; a top and a bottom surface of the outer rod being obliquely disposed with respect to a horizontal line as the outer rod extends from vertical column.

8. The lift of claim 1, wherein the central wheel is larger than the side wheel.

9. The lift of claim 1, wherein the hook stand comprises:

(a) a concave rod; and (b) a plurality of hooks extending outwardly from within the concave rod.

10. The lift of claim 1, further comprising:

(a) an elongate stand member hingedly extending from the vertical column such that, the stand member, as viewed from above, bifurcates the right and left support members, a distal free end of a stand rod adapted to receive the hook stand therewithin; and (b) an obliquely-positioned, elongate telescopic actuator hingedly secured at the bottom of the vertical column; the actuator for elevating and lowering the hook stand; the actuator controlled from an electronic user terminal.

11. The lift of claim 10, wherein the user terminal is removably secured to the vertical column.

12. The lift of claim 10, wherein a top extremity and a bottom extremity of the actuator are hingedly coupled to the stand member and the vertical column respectively.

13. The lift of claim 10, wherein the stand member comprises:

(a) a pair of parallel, elongate top and bottom stand rods, each of which extending between a proximal and a distal extremity, the pair of stand rods hingedly connected to the vertical column at the proximal extremities thereof, a top extremity of the actuator hingedly secured to the bottom stand rod; and (b) a hook stand receptacle hingedly connected at the distal extremities of the pair of stand rods, the hook stand receptacle adapted for removably receiving the hook stand.

14. The lift of claim 1, wherein each of the central and side wheels comprises a cart wheel.

15. The lift of claim 1, wherein the bottom rod declines as it extends from the side wheel to the connecting rod.

16. The lift of claim 1, wherein the handle bar is foldable.

17. The lift of claim 1, wherein the vertical column is of uniform rectangular cross-section.

18. The lift of claim 1, wherein each of the top, bottom and the connecting rods are of uniform rectangular cross-section.

19. The lift of claim 1, further comprising:

(a) a central wheel receptacle for rotably receiving the central wheel therewithin, the central wheel receptacle disposed at the bottom of the vertical column such that, the central wheel receptacle is disposed between the bottom of the vertical column and the central wheel; and (b) an elongate vertical swivel rod extending between the handle bar and the central wheel receptacle while being received within the vertical column; the swivel rod for facilitating a translation of swivel movement from the handle bar to the central wheel.

20. A portable assistive lift comprising:

(a) a vertical member comprising:

(i) a vertical column;

(ii) a handle bar disposed atop the vertical column; and (iii) a central cart wheel disposed at a bottom end of the vertical column, swiveling of the central wheel facilitated by swiveling of the handle;

(b) a pair of left and right support members, each of which comprising:

(i) an elongate, horizontal top rod extending from the vertical column;

(ii) an elongate, bottom rod disposed below the top rod, the bottom rod being elevated above ground, the bottom rod, as viewed from above, is disposed in a perpendicular orientation with respect to the top rod albeit in a different geometrical plane;

(iii) a side cart wheel disposed at a distal extremity of the bottom rod whereby, the lift is maneuvered about the central and side wheels; and (iv) a connecting rod connecting the top and bottom rods respectively whereby, the vertical member and the top, bottom and the connecting rods, as viewed from above, form U-shaped structure;

(c) a hook stand comprising a plurality of hooks about which a sling is coupled thereto;

(d) an elongate stand member hingedly extending from the vertical column such that, the stand member, as viewed from above, bifurcates the right and left support members, a distal free end of the stand rod adapted to receive the hook stand therewithin; and (e) an obliquely-positioned, elongate telescopic actuator hingedly secured at a bottom of the vertical column; the actuator for elevating and lowering the hook stand; and an electronic user terminal for controlling an extension and retraction of the actuator so as to control an ascent and descent of the hook stand respectively.

* * * * *